US006667694B2

(12) United States Patent
Ben-Ari et al.

(10) Patent No.: US 6,667,694 B2
(45) Date of Patent: Dec. 23, 2003

(54) GAZE-ACTUATED INFORMATION SYSTEM

(75) Inventors: Tsafrir Ben-Ari, Nahalal (IL); Ronen Ben-Horin, Haifa (IL)

(73) Assignee: Rafael-Armanent Development Authority Ltd., Haifa (IL)

( * ) Notice: Subject to any disclaimer, the term of this patent is extended or adjusted under 35 U.S.C. 154(b) by 105 days.

(21) Appl. No.: 09/963,443

(22) Filed: Sep. 27, 2001

(65) Prior Publication Data

US 2002/0039073 A1 Apr. 4, 2002

(30) Foreign Application Priority Data

Oct. 3, 2000 (IL) ..... 138831

(51) Int. Cl.[7] ..... G01C 21/00

(52) U.S. Cl. ..... 340/980; 340/961; 345/8; 359/630

(58) Field of Search ..... 340/980, 945, 340/963, 961; 345/8, 7, 9; 359/630, 633, 634; 702/150, 85, 92; 235/411; 89/41.22, 41.06

(56) References Cited

U.S. PATENT DOCUMENTS 5,072,218 A * 12/1991 Spero et al. ..... 340/980
5,347,910 A * 9/1994 Avila et al. ..... 89/41.22
5,583,795 A 12/1996 Smyth ..... 702/85
5,646,525 A 7/1997 Gilboa ..... 324/207.17
5,647,016 A * 7/1997 Takeyama ..... 340/961
5,649,061 A * 7/1997 Smyth ..... 128/731
6,359,601 B1 * 3/2002 Maguire, Jr. ..... 345/7
6,377,401 B1 * 4/2002 Bartlett ..... 359/630

* cited by examiner

*Primary Examiner*—Brent A. Swarthout
(74) *Attorney, Agent, or Firm*—Mark M. Friedman

(57) ABSTRACT

A method for providing a pilot with information associated with at least one region of a field of view visible to the pilot from within a cockpit without requiring a visual display. The method includes the steps of determining an eye gaze direction relative to a given frame of reference for at least one eye of the pilot, determining a reference direction relative to the given frame of reference, comparing the eye gaze direction with the reference direction, and if the eye gaze direction and the reference direction are equal to within a given degree of accuracy, generating audio output audible to the pilot and indicative of information associated with the reference direction.

18 Claims, 8 Drawing Sheets

GAZE-ACTUATED INFORMATION SYSTEM

FIELD AND BACKGROUND OF THE INVENTION

The present invention relates to systems for providing information to the pilot of an aircraft and, in particular, it concerns a system for providing selected information to a pilot based on his gaze-direction without use of a visual display. In one application, the invention specifically addresses the control interface between a pilot and a weapon system through which the pilot designates and verifies tracking of a target by the weapon system.

The extremely high speed of modern air-to-air combat stretches the capabilities of a human pilot to their limits. Faced with complex aircraft instrumentation and high-tech weapon systems, a pilot is required to achieve split-second reaction times as supersonic aircraft pass each other at relative speeds up to thousands of miles per hour. Various high performance target-seeking air-to-air missiles have been developed to operate under these conditions. Nevertheless, the process of cueing such missiles and verifying that they are locked-on to the correct target before firing may be extremely difficult for the pilot, especially while simultaneously flying an aircraft under conditions of constantly varying orientation, extreme inertial forces and high stress.

To facilitate rapid designation of targets, a head-up display is typically used to indicate the current cueing direction. A display symbol representing the direction of regard of the missile seeker is brought into superposition with a directly viewed target and the seeker is then allowed to track the target. If the pilot sees that the display symbol is following the viewed target, he knows that the tracking is proceeding properly and can proceed to fire the missile.

Many state-of-the-art systems employ a helmet-mounted head-up display. In this case, the seeker typically follows an optical axis of the display which moves together with the helmet, the helmet position being monitored either by a magnetic or an optical system. Cueing is achieved by the pilot turning his head, and hence the helmet, to bring the optical axis into alignment with the target. Examples of such systems are commercially available, amongst others, from Elbit Ltd. (Israel) and Comulus (South Africa).

Despite the major technological advances which have been made in the implementation of helmet-mounted displays and cueing systems, such systems still suffer from a large number of disadvantages, as will now be detailed.

Firstly, the components mounted in the helmet add greatly to the weight of the helmet. This weight becomes multiplied numerous times under high-acceleration conditions, becoming a major source of fatigue and stress for the pilot.

Secondly, these systems generally require alignment of the optical axis of the helmet with the target to be designated. This limits operation of the system to the angular range of helmet motion which the pilot can achieve. This is typically smaller than the actual field of view both of the pilot and of the seeker of the air-to-air missiles, thereby limiting performance unnecessarily. Furthermore, shifting of the entire head together with the heavy helmet to the required angle under high acceleration conditions may require great effort, and may cause significant delay in the cueing procedure.

Thirdly, the helmet-mounted display typically requires very substantial connections between the helmet and other devices within the aircraft. These connections generally include a significant power supply and electrical and/or optical fibers for carrying projected information for the display. Such connections pose a significant safety hazard for the pilot, particularly with respect to emergency ejection where a special guillotine is required to sever the connections in case of emergency. The supply of a high voltage power line to within the helmet is also viewed as a particular safety hazard.

Finally, the integration of a head mounted display and cueing system into the aircraft systems is a highly expensive project, requiring adaptation of numerous subsystems, with all the complications of safety and reliability evaluation procedures and the like which this entails.

In addition to the specific issue of cueing and verifying correct tracking of weapon systems, modern aircraft include multiple information systems which in many cases generate information relating to objects or locations visible to the pilot. Such systems typically include radar and navigation systems of various types, as well as data systems. In many cases, DataLink (DL) systems are provided which can offer a wide variety of information, such as identifying other aircraft as friendly or hostile, identifying the type of aircraft and even provide information regarding the armament of the aircraft. Navigation related information typically includes the identity of various visible landmarks such mountains or cities. Commercially available examples of such systems in the U.S. include the systems known by the names "Link4" and Link16". In many cases it would be highly advantageous to provide this information on a head-up display so that it would be visually linked in an intuitive way to the pilot's field of view. This however can only be achieved over a useful field of view by employing a helmet-mounted display with all of the aforementioned disadvantages.

Turning now to the field of eye-motion tracking, various techniques have been developed for identifying the gaze direction of the human eye. Examples of a number of commercially available systems for tracking eye movements may be obtained from ASL Applied Science Laboratories (Bedford, Mass., USA).

U.S. Pat. No. 5,583,795 to Smyth proposes a helmet-mounted apparatus for measuring eye gaze while providing a helmet-mounted display. Brief reference is made to the possibility of using the apparatus for "designating targets" and "weapon system pointing". Such a system, however, would still suffer from most of the aforementioned shortcomings associated with helmet-mounted display systems.

There is therefore a need for a gaze-actuated information system which would facilitate rapid and reliable cueing and tracking verification of air-to-air missiles without the pilot having to turn his entire head and without requiring substantial additional connections or expensive modification of aircraft systems. It would also be highly advantageous to provide a method for providing information, including confirming that a weapon system is locked-on to a visible target, without requiring use of a visual display.

SUMMARY OF THE INVENTION

The present invention is a gaze-actuated information system and method which provides information associated with various gaze directions within a field of view. Amongst other applications, the system and method may be used for confirming that a weapon system is locked-on to a visible target without use of a visual display. This allows the helmet-mounted parts of the system to be implemented as lightweight components, thereby rendering the helmet much lighter and easier to use than systems with helmet-mounted displays.

According to the teachings of the present invention there is provided, a method for providing a pilot with information associated with at least one region of a field of view visible to the pilot from within a cockpit without requiring a visual display, the method comprising the steps of: (a) determining an eye gaze direction relative to a given frame of reference for at least one eye of the pilot; (b) determining a reference direction relative to the given frame of reference; (c) comparing the eye gaze direction with the reference direction; and (d) if the eye gaze direction and the reference direction are equal to within a given degree of accuracy, generating audio output audible to the pilot and indicative of information associated with the reference direction.

According to a further feature of the present invention, the reference direction corresponds to a direction from a weapon system to a target to which the weapon system is locked-on, such that the audio output provides confirmation that the weapon system is locked-on to a target at which the pilot is currently gazing.

According to a further feature of the present invention, the reference direction corresponds to a direction from the cockpit to a friendly aircraft, such that the audio output provides an indication that an aircraft at which the pilot is currently gazing is friendly.

According to a further feature of the present invention, the reference direction corresponds to a direction from the cockpit to a hostile aircraft, such that the audio output provides an indication that an aircraft at which the pilot is currently gazing is hostile.

According to a further feature of the present invention, the reference direction corresponds to a direction from the cockpit to a landmark, such that the audio output provides information relating to the landmark at which the pilot is currently gazing.

According to a further feature of the present invention, the given degree of accuracy corresponds to a maximum allowed angular discrepancy between the eye gaze direction and the reference direction, the maximum allowed discrepancy having a value of less than 5°, and preferably less than 2°.

According to a further feature of the present invention, the determining an eye gaze direction includes: (a) employing a helmet-mounted system to derive direction information related to a relative eye gaze direction for at least one eye of the pilot relative to a helmet worn by the pilot; (b) transmitting the direction information via a cordless communications link to a receiver unit; (c) deriving position information related to a position of the helmet within a cockpit; and (d) processing the direction information and the position information to derive the eye gaze direction relative to a frame of reference associate with the cockpit.

According to a further feature of the present invention, the helmet-mounted system and a helmet-mounted portion of the cordless communications link are implemented using low-power electrical components powered exclusively by at least one helmet-mounted battery.

There is also provided according to the teachings of the present invention, a gaze-actuated information system for providing a pilot with information associated with at least one region of a field of view visible to the pilot from within a cockpit without requiring a visual display, the system comprising: (a) a gaze-direction determining system deployed within the cockpit and configured to determine a current gaze direction of the pilot relative to the cockpit; (b) a direction correlation system associated with the gaze-direction determining system and configured to compare the current gaze direction with at least one reference direction and to generate a correlation signal when the current gaze direction is equal to the reference direction within a predefined margin of error; and (c) an audio output system associated with the direction correlation system and configured to be responsive to the correlation signal to generate audio output audible to the pilot and indicative of information related to the reference direction.

According to a further feature of the present invention, there is also provided a weapon system including a seeker operative to track a target, the weapon system generating a current target direction corresponding to the direction from the seeker to the target being tracked, the direction correlation system being associated with the weapon system and configured to employ the current target direction as one of the reference directions such that, when the pilot looks towards the target, the audio output system generates audio output indicative that the currently viewed target is being tracked.

According to a further feature of the present invention, the gaze-direction determining system includes: (a) a helmet-mounted system configured to derive relative direction information related to a relative eye gaze direction for at least one eye of the pilot relative to a helmet worn by the pilot; and (b) a helmet positioning system configured to derive position information related to a position of the helmet within the cockpit.

According to a further feature of the present invention, the gaze-direction determining system further includes a transmitter deployed for transmitting a wireless signal containing information from the helmet-mounted system.

According to a further feature of the present invention, the helmet-mounted system and the transmitter are implemented using low-power electrical components powered exclusively by at least one helmet-mounted battery.

There is also provided according to the teachings of the present invention, a method for providing to a pilot confirmation that a weapon system is locked-on to a visible target without use of a visual display, the method comprising the steps of: (a) determining an eye gaze direction relative to a given frame of reference for at least one eye of the pilot; (b) determining a target direction representing the direction relative to the given frame of reference from the weapon system to the target to which the weapon system is locked-on; (c) comparing the eye gaze direction with the target direction; and (d) if the eye gaze direction and the target direction are equal to within a given degree of accuracy, generating a predefined audible signal to confirm that the weapon system is locked-on to a target at which the pilot is currently gazing.

According to a further feature of the present invention, the given degree of accuracy corresponds to a maximum allowed angular discrepancy between the eye gaze direction and the target direction, the maximum allowed discrepancy having a value of less than 5°, and preferably less than 2°.

According to a further feature of the present invention, the determining an eye gaze direction includes: (a) employing a helmet-mounted system to derive direction information related to a relative eye gaze direction for at least one eye of the pilot relative to a helmet worn by the pilot; (b) transmitting the direction information via a cordless communications link to a receiver unit; (c) deriving position information related to a position of the helmet within a cockpit; and (d) processing the direction information and the position information to derive the eye gaze direction relative to a frame of reference associate with the cockpit.

According to a further feature of the present invention, the helmet-mounted system and a helmet-mounted portion of the cordless communications link are implemented using low-power electrical components powered exclusively by at least one helmet-mounted battery.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
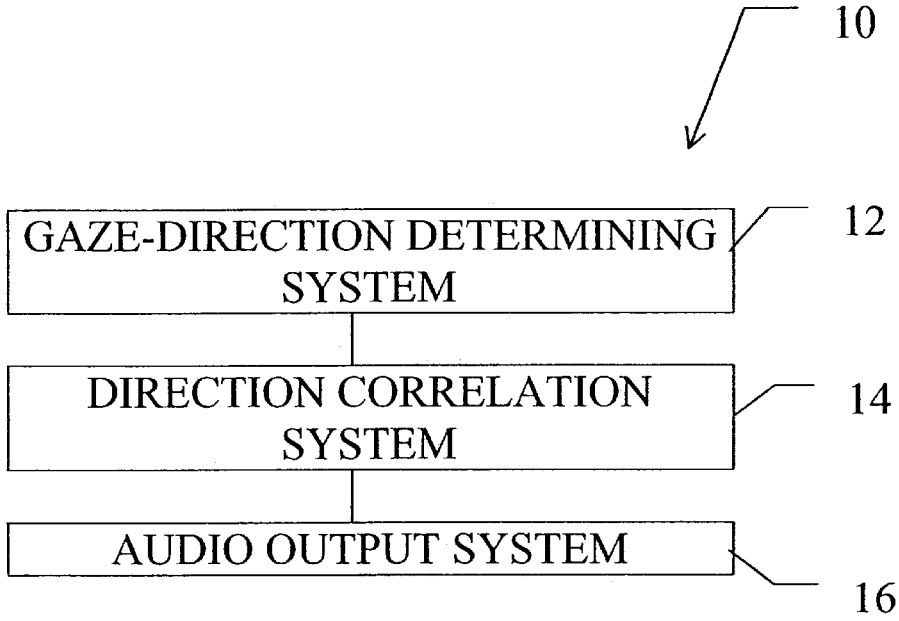
FIG. 1 is a general block diagram illustrating the main sub-systems of a gaze-actuated information system, constructed and operative according to the teachings of the present invention, for providing a pilot with information associated with at least one region of a field of view visible to the pilot.

The present invention is a gaze-actuated information system and method which provides information associated with various gaze directions within a field of view. Amongst other applications, the system and method may be used for confirming that a weapon system is locked-on to a visible target without use of a visual display.

The principles and operation of systems and methods according to the present invention may be better understood with reference to the drawings and the accompanying description.

Referring now to the drawings, FIGS. 1–3 and 6 show a gaze-actuated information system, generally designated 10, constructed and operative according to the teachings of the present invention, for providing a pilot with information associated with at least one region of a field of view visible to the pilot from within a cockpit without requiring a visual display.

Generally speaking, the system includes a gaze-direction determining system 12 deployed within the cockpit and configured to determine a current gaze direction of the pilot relative to the cockpit. A direction correlation system 14 is configured to compare the current gaze direction with at least one reference direction and to generate a correlation signal when the current gaze direction is equal to the reference direction within a predefined margin of error. An audio output system 16 is responsive to the correlation signal to generate audio output audible to the pilot and indicative of information related to the reference direction.

It will be readily appreciated that the system thus defined provides a highly advantageous combination of properties. On one hand, employing the gaze direction to identify objects about which the pilot wants information ensures that the information is related in an intuitive manner to the environment seen by the pilot. At the same time, since the information is provided as audio output, the aforementioned problems associated with helmet-mounted displays can be avoided. This and other advantages of the system and method of the present invention will become clearer from the following description and drawings.

By way of non-limiting examples, the invention will be described in the context of two implementations. A first preferred implementation, detailed in FIGS. 2–5, illustrates an application of the system and method of the present invention to a dedicated weapon control system which can be implemented with minimal integration into existing aircraft systems. A second preferred implementation, detailed in FIGS. 6–8, relates to an extension of the system and method of the invention by integration into the aircraft systems to provide a range of additional information, preferably in addition to offering all the features of the implementation of FIGS. 2–5.

Turning now to FIGS. 2–5, there is shown an implementation of system 10 for controlling a weapon system 18, particularly an air-to-air missile system, with a target-tracking seeker 20 and a launcher 22. Weapon system 18 generates a current target direction corresponding to the direction from seeker 20 to a target currently being tracked. In this case, it is a particularly preferred feature of the present invention that direction correlation system 14 is configured to employ the current target direction as a reference direction such that, when the pilot looks towards the target, the audio output system generates audio output indicative that the currently viewed target is being tracked.

The various systems of FIG. 1 are typically implemented as combinations of components which may be subdivided between two or more physical units. Thus, in FIG. 2, the components together making up gaze-direction determining system 12 are subdivided between a helmet-mounted system 24 and a cockpit-mounted system 26. Specifically, helmet-mounted system 24 preferably includes an eye tracking system 28 configured to derive relative direction information related to a relative eye gaze direction for at least one eye, and preferably both eyes, of the pilot relative to a helmet worn by the pilot. A helmet positioning system 30, mounted wholly or mainly as part of cockpit-mounted system 26, is configured to derive position information related to a position of the helmet within the cockpit. These two sets of information, providing the direction of the eye gaze relative to the helmet and the helmet position within the cockpit, are processed by a processor 32 to derive the eye gaze direction relative to a frame of reference moving with the cockpit.

Eye tracking system 28 may be of any type suitable for helmet mounting in a manner which will not significantly interfere with the pilot's performance. Typically, the system includes a transparent reflector positioned in front of the eye via which a miniature camera acquires images of the eye position. The required optical and computational technology is well documented in the literature and available in commercial products. By way of a non-limiting example, system 28 may be implemented as an off-the-shelf commercial unit, such as ASL Model 501, commercially available from Applied Science Laboratories of Bedford, Mass. (USA). In most cases, however, it is preferable to use a somewhat adapted unit which employs smaller reflectors mounted towards the sides of the face and compact cameras mounted at the sides, thereby improving the operational safety under flight conditions, and rendering the structure sufficiently strong to withstand forces of up to 10G. Such adaptations are within the capabilities of one ordinarily skilled in the art.

Similarly, helmet positioning system 30 may be any type of helmet position measuring system, including but not limited to, magnetic systems, and optical systems using active and/or passive markers. Optical systems are generally preferred for their reliability, simplicity and light helmet weight. An examples of a suitable helmet positioning system is the Guardian Helmet Tracker System commercially available from Cumulus (South Africa). Examples of generic spatial measurement systems of all three aforementioned types (magnetic, active optical and passive optical) are commercially available from NDI Northern Digital Inc. of Waterloo, Ontario (Canada).

As mentioned earlier, it is a particular feature of preferred implementations of the present invention that it can be implemented in a lightweight helmet without a helmet-mounted display. This avoids the need for heavy display components and high-voltage electrical connections to the helmet. Power to, and output from, eye tracking system 28 can optionally be transferred along the pre-existing communications wiring into the helmet in the form of low-voltage DC and high frequency signal modulation, respectively, as is known in the art of signal processing. In a more preferred implementation, however, the advantages of the present invention are enhanced by employing a wireless communications system to transfer data from eye-tracking system 28 to cockpit-mounted system 26. Specifically, helmet-mounted system 24 preferably includes a transmitter 34 while cockpit-mounted system 24 preferably includes a corresponding receiver or transceiver 36. The transmitter and transceiver preferably operate using a short range RF link.

In order to make the helmet-mounted system fully independent of wired connections, eye tracking system 28 and transmitter 34 are preferably implemented using low-power electrical components powered exclusively by at least one helmet-mounted battery 38. Such a low-power, battery operated system requires further adaptation from the commercial systems mentioned above. Such adaptation, which is within the capabilities of one ordinarily skilled in the art, may be based upon the technology such as is used in the disposable imaging capsule developed by Given Imaging Ltd. of Yokneam (Israel) which includes a video camera and transmitter for outputting diagnostic medical imaging of the intestinal tract.

Direction correlation system 14 is typically implemented as a processor which receives gaze direction information from processor 32 and reference direction information from weapon system 18. In the preferred implementation shown here, the direction correlation system is implemented using additional software modules within the same processor 32 as is employed for the gaze direction determining system.

Audio output system 16 is implemented using an audio system 40 which may be either a dedicated system or part of an existing audio system for providing radio communication or the like to the pilot. In either case, the sound must typically be provided to the pilot via the pre-existing headset (not shown) to compete with ambient noise levels. Depending upon the type of information to be provided (to be discussed below), audio output system 16 may include simple tone generators, or may be implemented with voice message capabilities, such as by provision of a voice synthesizer or prerecorded messages. The processing functions required by the audio output system may be provided as a separate processor within audio system 40, or may also be integrated with processor 32, as will be clear to one ordinarily skilled in the art.

As mentioned before, the implementation of FIG. 2 is preferably implemented with minimal integration into the existing aircraft systems. To this end, the system preferably includes a weapon system unit 42 which is associated with each weapon system 18 for relaying seeker direction information from the weapon system directly to the cockpit-mounted system 26 without use of the aircraft electronics systems. Thus, weapon system unit 42 is shown here with a control interface 44 linked so as to receive information from seeker 20 and a transceiver 46 for transmitting target direction information to a cockpit-mounted transceiver. In the preferred case illustrated here, the communications link used is of a similar type to that between the helmet-mounted system and the cockpit-mounted system, allowing a single transceiver 36 to be used for both links. Alternatively, a separate wireless connection, such as a line-of-sight IR communications link, may be preferred.

Optionally, control interface 44 may additionally be linked to launcher 22 to actuate launching of the missile. Alternatively, the launching control system may be a conventional system operating via the existing aircraft systems and independent of the system components described here.

It will be appreciated that the system thus described is independent of the main electronic systems of the aircraft. Specifically, the only necessary electronic integration is performed directly with the seeker of the weapon system, independent of the aircraft systems. Since all directions are measured relative to a frame of reference moving with the aircraft, connection to the aircraft navigational systems may be avoided. The remaining connections may be limited to straightforward electrical connections to the pilot's audio headset and power supplies 48, 50 for weapon system unit 42 and cockpit-mounted system 26, respectively. Optionally, one or both of power supplies 48, 50 can themselves be implemented as battery-operated units, thereby reducing the number of connections still further. In a further option, many existing aircraft systems provide an electrical audio connection from a signal generator within the missile launcher to the pilot's headset for signals generated on the basis of outputs from the missile. In such systems, audio system 40 can be implemented within weapon system unit 42 by providing suitable outputs to the existing signal generator. This may also allow further simplification of the system by avoiding the need for bi-directional wireless communication between cockpit-mounted system 26 and weapon system unit 42, allowing transceiver 46 to be replaced with a receiver. These various options render the system particularly convenient as a retrofit addition to existing aircraft.

Figure 2:
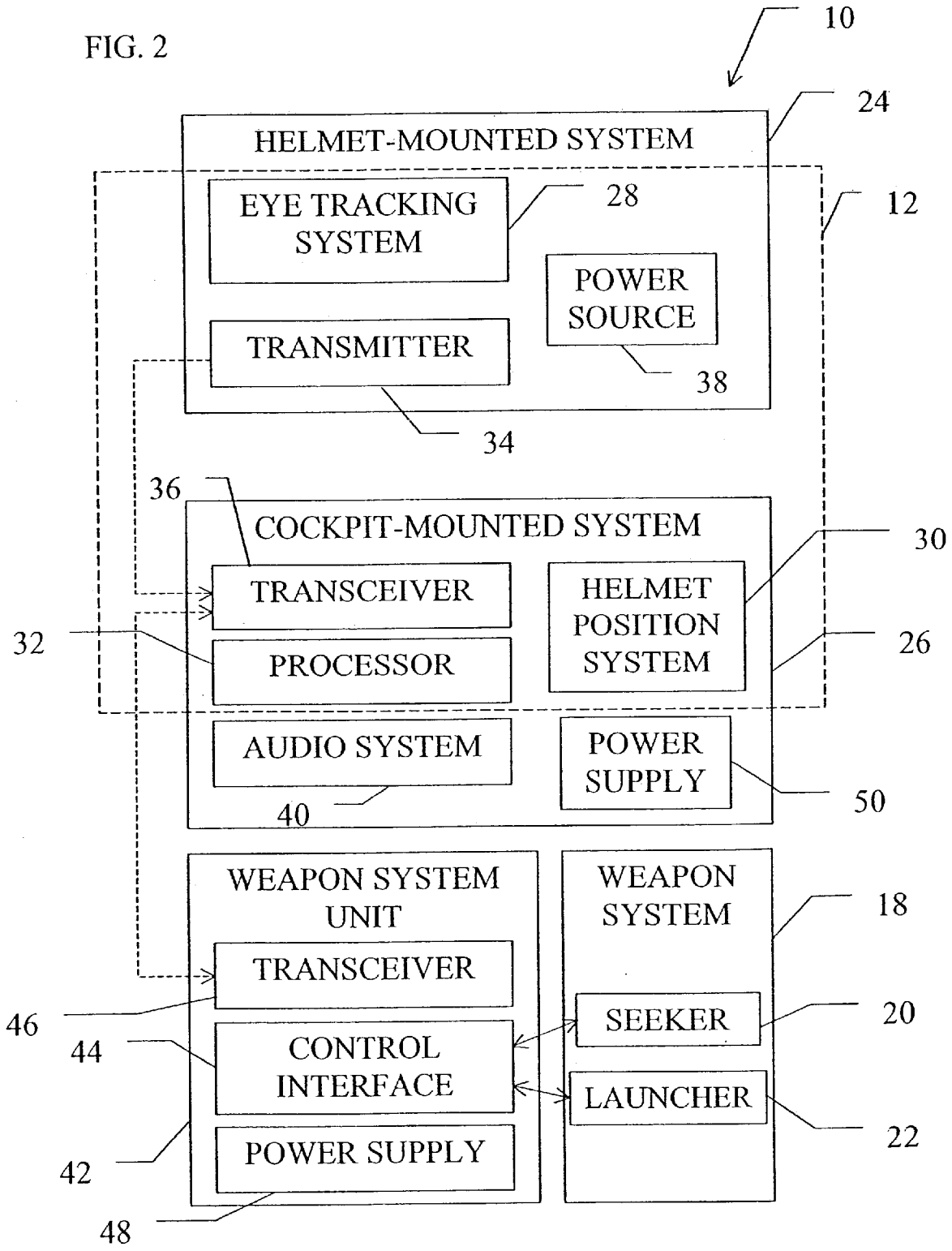
FIG. 2 is a more detailed block diagram illustrating the main components of a preferred implementation of the system of FIG. 1 for operating air-to-air missiles.
Figure 3:
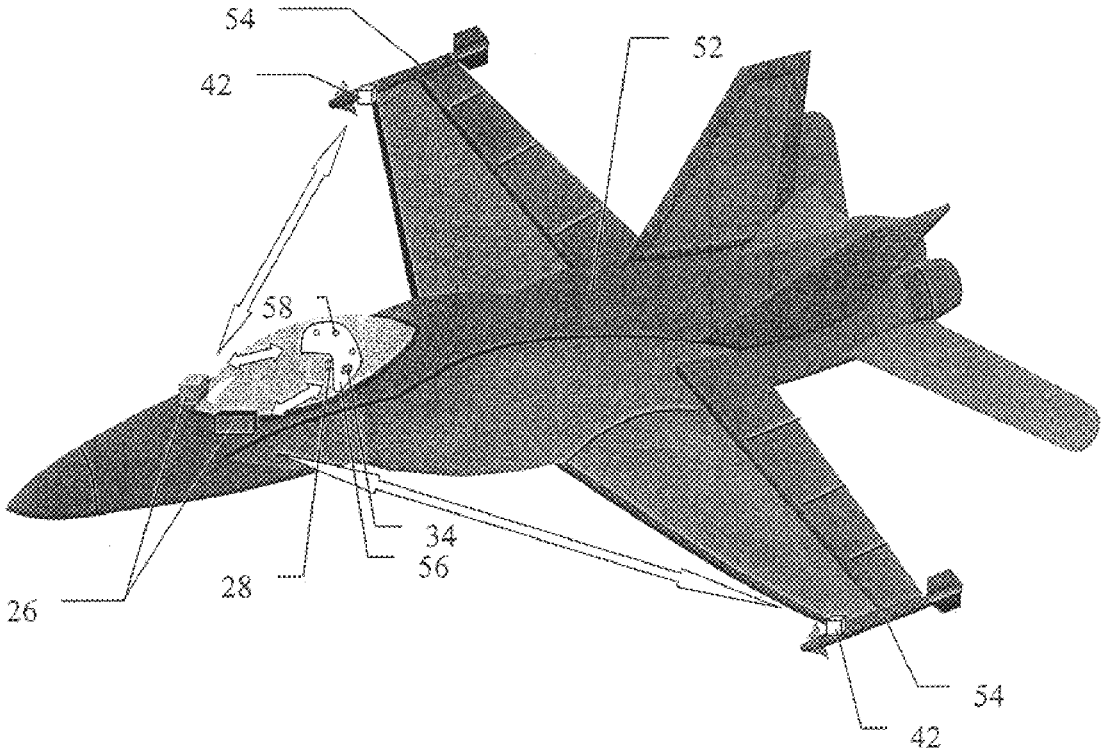
FIG. 3 is a schematic representation of an aircraft employing the system of FIG. 2.

FIG. 3 shows schematically the various components of the system of FIG. 2 as deployed on an aircraft 52 carrying air-to-air missiles 54. The pilot's helmet 56 carries the helmet-mounted system, including eye-tracking system 28 and transmitter 34, as well as a number of optical markers 58 for use by the helmet positioning system. Mounted near the pilot is the cockpit-mounted system 26, which may be subdivided into more than one unit and may have various components duplicated depending upon various design considerations (e.g., geometry of optical helmet positioning system, line-of-sight for communications link to weapon system units 42, etc.). Cockpit-mounted system 26 is in communication with a weapon system unit 42 associated with each missile 54. It will be appreciated that this representation is highly schematic and should not be taken to imply the actual size, shape or positioning of the various components.

Figure 4:
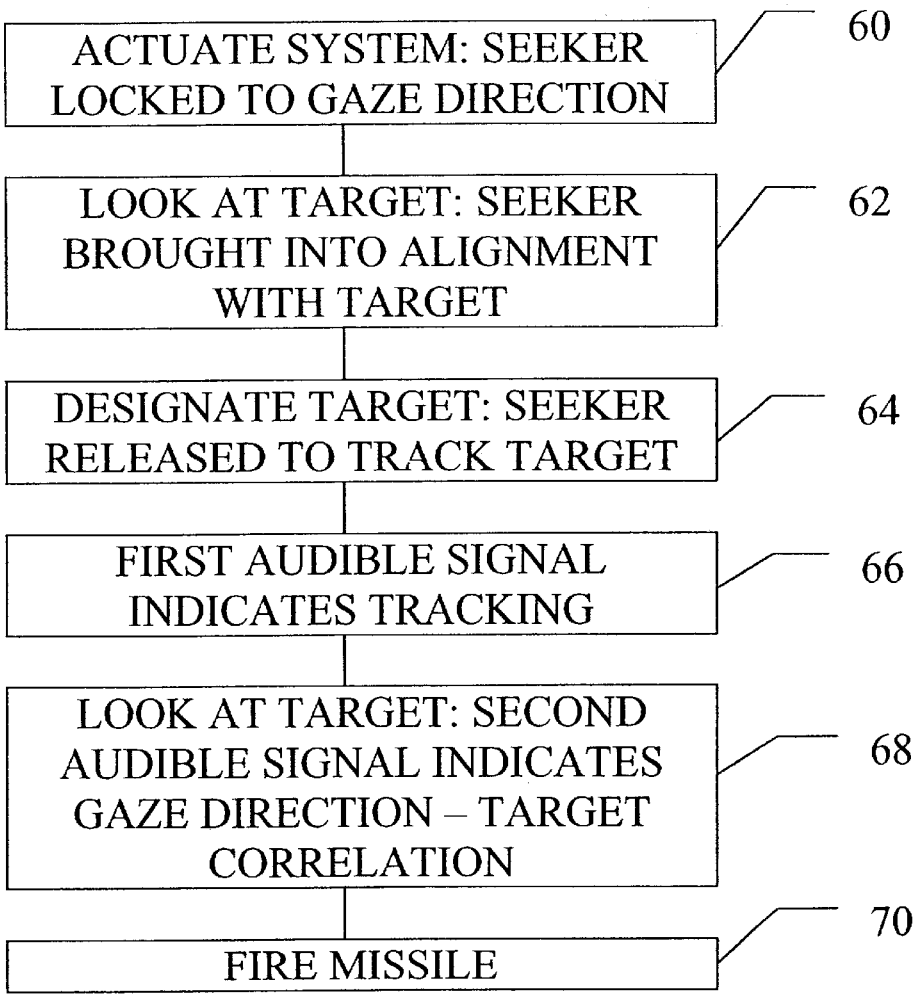
FIG. 4 is a flow diagram illustrating the operation of the system of FIG. 2.
Figure 5:
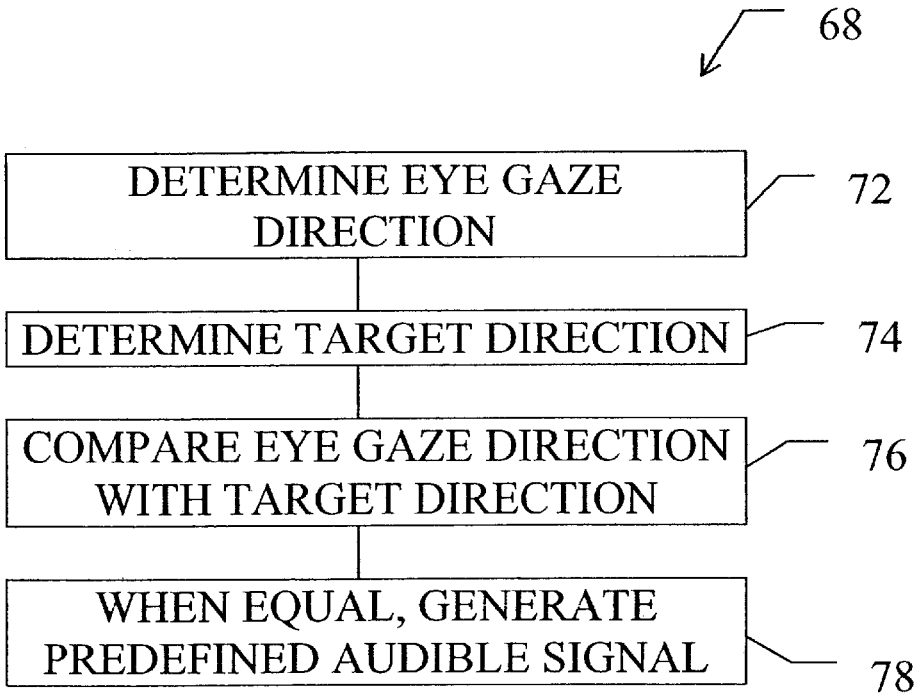
FIG. 5 is a detailed flow diagram, corresponding to block 68 of FIG. 4, illustrating a method according to the teachings of the present invention for confirming to a pilot that a weapon system is locked-on to a visible target without use of a visual display.

The operation of the system of FIGS. 2 and 3 is illustrated in FIGS. 4 and 5. Specifically, referring to FIG. 5, when the system is initially actuated (step 60), the gaze direction system preferably operates as an input system, providing a cueing direction to which seeker 20 is directed. This function is preferably also performed by control interface 44 in response to information transmitted from cockpit-mounted system 26. The result is that the seeker is effectively locked to the pilot's gaze direction, following his gaze towards any object at which he is currently looking.

Once this system is operational, the process of designating a target becomes very straightforward and intuitive. The pilot first looks towards a given target (step 62), thereby bringing the seeker into alignment with the target, and designates the target (step 64), such as by depressing a control button. This releases the seeker from the gaze direction, allowing it to track the target freely. Preferably, at this point, audio system 40 produces a first audible signal (step 66) to indicate to the pilot that the seeker has locked-on to a target and is continuing to track it.

At this point, having designated a target, the pilot must verify that the seeker has locked-on to the correct object (step 68) before he can safely proceed to fire the missile (step 70). In systems having a helmet-mounted head-up display, this verification would typically be performed by displaying a tracking symbol superimposed on the pilot's field of view which would indicate the direction of the target currently being tracked. It is a particularly preferred feature of the system and method of the present invention that such verification can be performed quickly and reliably without requiring a helmet-mounted display, as will now be described with reference to FIG. 5.

Specifically, verification step 68 includes determining the eye gaze direction relative to a given frame of reference for at least one eye of the pilot (step 72), determining a target direction representing the direction relative to the given frame of reference from the weapon system to the target to which the weapon system is locked-on (step 74), and comparing the eye gaze direction with the target direction (step 76). When the eye gaze direction and the target direction are equal to within a given degree of accuracy, i.e., that the pilot is currently looking at the target which is being tracked, a predefined audible signal is generated to confirm that the weapon system is locked-on to the target at which the pilot is currently gazing (step 78).

It will be readily apparent that this method of verification answers very well to the requirements of air-to-air combat. The audible signals can be simple tones which are immediately understood even under situations of great stress. The entire verification step typically takes place in a small fraction of a second, simply by glancing momentarily at the target. And by rendering the helmet-mounted display dispensable, the physical strain on the pilot is reduced while his level of safety is improved.

The criteria for correlation preferably corresponds to a maximum allowed angular discrepancy between the eye gaze direction and the target direction of less than 5°, and most preferably less than 2°. This is typically more than sufficient to allow for the sum total of all errors from the various measurement systems and the seeker.

Figure 6:
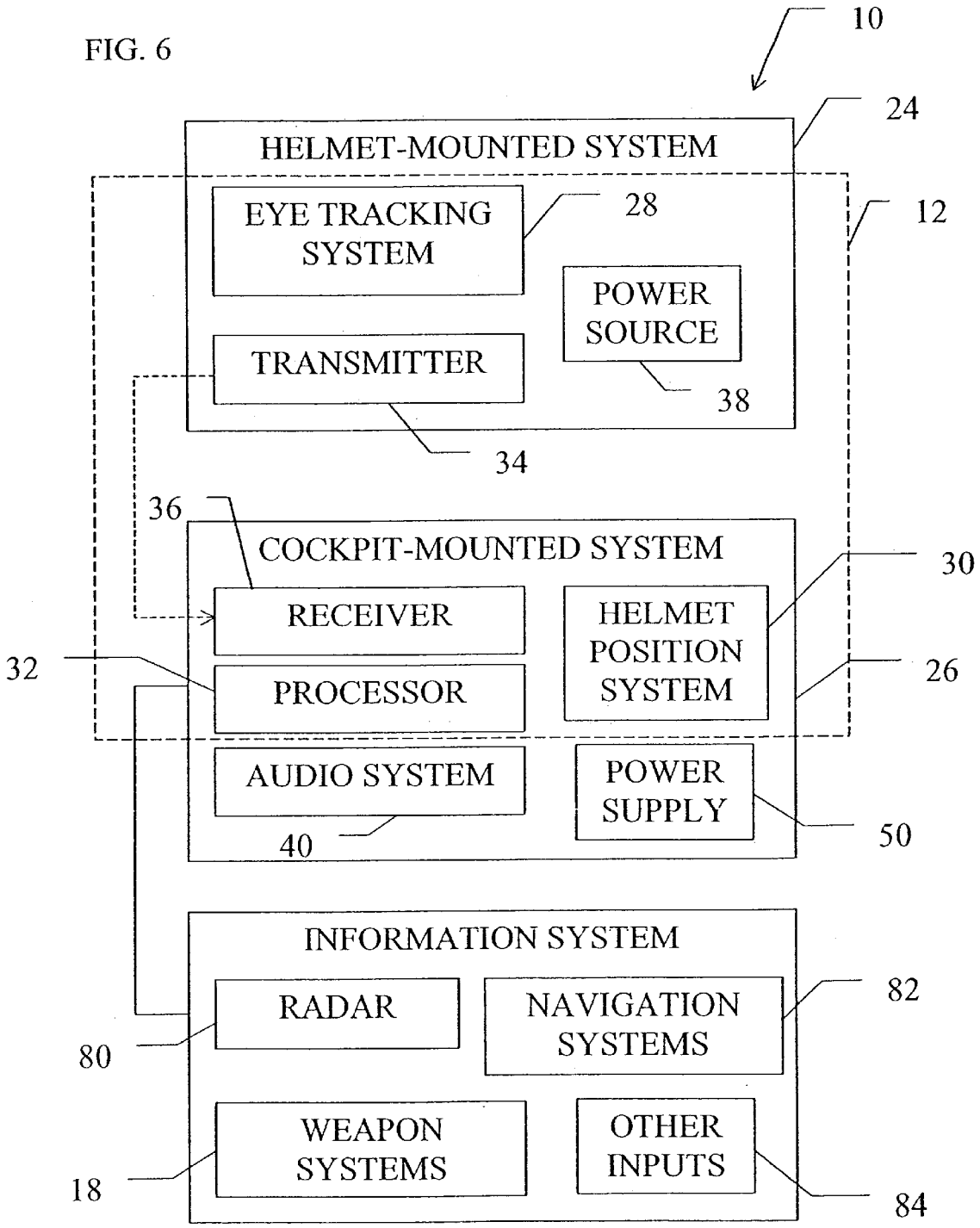
FIG. 6 is a more detailed block diagram illustrating the main components of an extended implementation of the system of FIG. 1.
Figure 7:
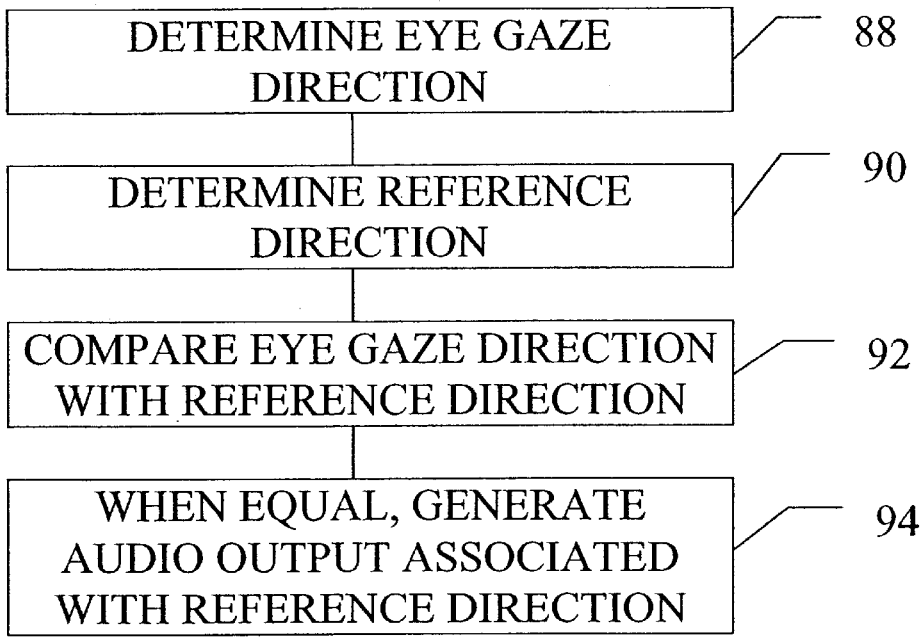
FIG. 7 is a flow diagram illustrating the operation of the system of FIG. 6.
Figure 8:
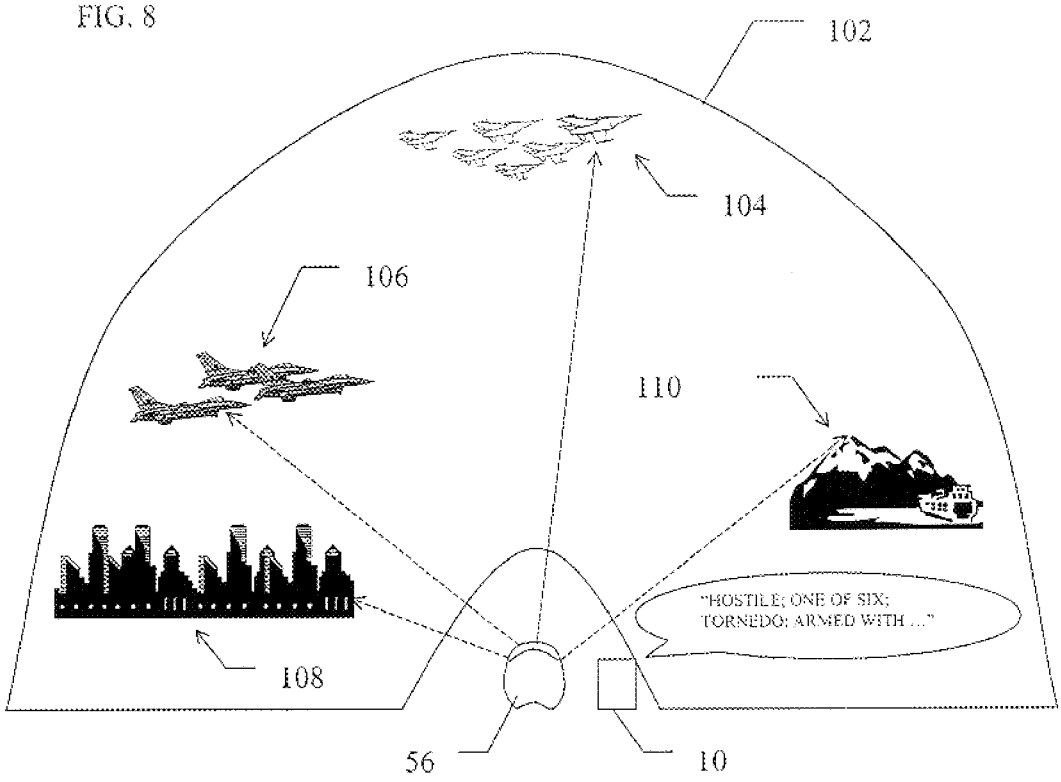
FIG. 8 is a schematic representation of a field of view of a pilot illustrating the operation of the system of FIG. 6.

Turning now to FIGS. 6–8, there is shown a second implementation of the system of FIG. 1 in which the system is integrated with aircraft information systems to provide a range of additional information. The structure and operation of the system is largely similar to that of FIGS. 2–5, equivalent elements being labeled similarly.

As mentioned earlier, certain modern aircraft systems offer a wide range of information from various sources including, but not limited to, radar 80, navigation systems 82, weapon systems 18 and various other information systems and inputs 84. By making this information available to processor 32, it becomes possible to provide this information in an audible form related to, and in response to, the gaze direction of the pilot.

Unlike the implementation of FIGS. 2–5, this implementation preferably calculates the pilot's gaze direction in a frame of reference not moving with the aircraft in order to allow integration of a wider range of information sources. To this end, processor 32 preferably receives inputs from the various navigation systems relating to attitude and position of the aircraft. These systems are typically the conventional navigation systems of the aircraft which may include an inertial navigation systems, GPS, tilt sensors and other devices, and do not per se constitute part of the present invention. The gaze direction calculation thus becomes a function of the aircraft position, in addition to the relative direction of eye-gaze relative to the helmet and the relative position of the helmet within the cockpit. The resulting direction is preferably represented as a vector in a geostationary frame of reference such that it can readily be compared with locations defined geographically on the ground or in the sky.

The operation of the system parallels the method described earlier. Specifically, with reference to FIG. 7, the system first determines an eye gaze direction relative to a given frame of reference for at least one eye of the pilot (step 88) and a reference direction relative to the given frame of reference (step 90). The reference direction is chosen to correspond to a region of the pilot's field of view with which certain information is associated. The system then compares the eye gaze direction with the reference direction (step 92) and, if the eye gaze direction and the reference direction are equal to within a given degree of accuracy, generates audio output audible to the pilot and indicative of the information associated with that reference direction (step 94).

This functionality is illustrated pictorially in FIG. 8 which shows the position of a helmet 56 and system 10 of the invention relative to a field of view 102 of the pilot. The field of view includes various distinctive objects, including hostile aircraft 104, friendly aircraft 106 and geographical landmarks such as a city 108 and a mountain 110. Information as to the positions of these various objects are provided to processor 32 from various sources such that a reference direction, represented by a dashed line, can be calculated for each. The actual gaze direction of the pilot, represented by a solid line, moves freely around the field of view. When it comes into alignment with one of the reference directions, system 10 provides information relating to that region of the field of view, typically in the form of a voice message. Thus, when looking at a hostile aircraft 104, the system may provide whatever information is available relating to the aircraft, such as the fact that it is potentially hostile, the type of aircraft and its armaments (for example, derived from a combination of its radar signature and look-up tables of aircraft specifications). When looking at a friendly aircraft, the system may identify it as friendly (for example, on the basis of an encoded marker signal or the like) to avoid potentially dangerous confusion. When looking at a city or mountain, the system may identify the landmark to facilitate navigation.

During active combat, the system preferably provides the functions described above with reference to FIGS. 2–5, in addition to the aforementioned information. Optionally, some or all of the non-combat-related information may be suppressed during combat to remove all non-vital distractions.

It will be appreciated that the above descriptions are intended only to serve as examples, and that many other embodiments are possible within the spirit and the scope of the present invention as defined by the appended claims.

What is claimed is:

1. A method for providing a pilot with information associated with at least one region of a field of view visible to the pilot from within a cockpit without requiring a visual display, the method comprising the steps of:

(i) determining an eye gaze direction relative to a given frame of reference for at least one eye of the pilot by:

(a) employing a helmet-mounted system to derive direction information related to a relative eye gaze direction for at least one eye of the pilot relative to a helmet worn by the pilot, (b) deriving position information related to a position of said helmet within a cockpit, and (c) processing said direction information and said position information to derive said eye gaze direction relative to a frame of reference associate with said cockpit;

(ii) determining a reference direction relative to said given frame of reference;

(iii) comparing said eye gaze direction with said reference direction; and (iv) if said eye gaze direction and said reference direction are equal to within a given degree of accuracy, generating audio output audible to the pilot and indicative of information associated with said reference direction.

2. The method of claim 1, wherein said reference direction corresponds to a direction from a weapon system to a target to which the weapon system is locked-on, such that said audio output provides confirmation that the weapon system is locked-on to a target at which the pilot is currently gazing.

3. The method of claim 1, wherein said reference direction corresponds to a direction from the cockpit to a friendly aircraft, such that said audio output provides an indication that an aircraft at which the pilot is currently gazing is friendly.

4. The method of claim 1, wherein said reference direction corresponds to a direction from the cockpit to a hostile aircraft, such that said audio output provides an indication that an aircraft at which the pilot is currently gazing is hostile.

5. The method of claim 1, wherein said reference direction corresponds to a direction from the cockpit to a landmark, such that said audio output provides information relating to the landmark at which the pilot is currently gazing.

6. The method of claim 1, wherein said given degree of accuracy corresponds to a maximum allowed angular discrepancy between said eye gaze direction and said reference direction, said maximum allowed discrepancy having a value of less than 50°.

7. The method of claim 1, wherein said given degree of accuracy corresponds to a maximum allowed angular discrepancy between said eye gaze direction and said reference direction, said maximum allowed discrepancy having a value of less than 2°.

8. The method of claim 1, wherein said determining an eye gaze direction includes transmitting said direction information from said helmet mounted system to a receiver unit via a cordless communications link.

9. The method of claim 8, wherein said helmet-mounted system and a helmet-mounted portion of said cordless communications link are implemented using low-power electrical components powered exclusively by at least one helmet-mounted battery.

10. A gaze-actuated information system for providing a pilot with information associated with at least one region of a field of view visible to the pilot from within a cockpit without requiring a visual display, the system comprising:

(i) a gaze-direction determining system deployed within the cockpit and configured to determine a current gaze direction of the pilot relative to the cockpit said gaze-direction determining system including:

(a) a helmet-mounted system configured to derive relative direction information related to a relative eye gaze direction for at least one eye of the pilot relative to a helmet worn by the pilot, and (b) a helmet positioning system configured to derive position information related to a position of said helmet within the cockpit (ii) a direction correlation system associated with said gaze-direction determining system and configured to compare said current gaze direction with at least one reference direction and to generate a correlation signal when said current gaze direction is equal to said reference direction within a predefined margin of error; and (iii) an audio output system associated with said direction correlation system and configured to be responsive to said correlation signal to generate audio output audible to the pilot and indicative of information related to said reference direction.

11. The gaze-actuated information system of claim 10, further comprising a weapon system including a seeker operative to track a target, said weapon system generating a current target direction corresponding to the direction from the seeker to the target being tracked, said direction correlation system being associated with said weapon system and configured to employ said current target direction as one of said reference directions such that, when the pilot looks towards the target, said audio output system generates audio output indicative that the currently viewed target is being tracked.

12. The gaze-actuated information system of claim 10, wherein said gaze-direction determining system further includes a transmitter deployed for transmitting a wireless signal containing information from said helmet-mounted system.

13. The gaze-actuated information system of claim 12, wherein said helmet-mounted system and said transmitter are implemented using low-power electrical components powered exclusively by at least one helmet-mounted battery.

14. A method for providing to a pilot confirmation that a weapon system is locked-on to a visible target without use of a visual display, the method comprising the steps of:

(i) determining an eye gaze direction relative to a given frame of reference for at least one eye of the pilot;

(ii) determining a target direction representing the direction relative to said given frame of reference from the weapon system to the target to which the weapon system is locked-on;

(iii) comparing said eye gaze direction with said target direction; and (iv) if said eye gaze direction and said target direction are equal to within a given degree of accuracy, generating a predefined audible signal to confirm that the weapon system is locked-on to a target at which the pilot is currently gazing.

15. The method of claim 14, wherein said given degree of accuracy corresponds to a maximum allowed angular discrepancy between said eye gaze direction and said target direction, said maximum allowed discrepancy having a value of less than 5°.

16. The method of claim 14, wherein said given degree of accuracy corresponds to a maximum allowed angular discrepancy between said eye gaze direction and said target direction, said maximum allowed discrepancy having a value of less than 2°.

17. The method of claim 14, wherein said determining an eye gaze direction includes:

(i) employing a helmet-mounted system to derive direction information related to a relative eye gaze direction for at least one eye of the pilot relative to a helmet worn by the pilot;

(ii) transmitting said direction information via a cordless communications link to a receiver unit;

(iii) deriving position information related to a position of said helmet within a cockpit; and (iv) processing said direction information and said position information to derive said eye gaze direction relative to a frame of reference associate with said cockpit.

18. The method of claim 17, wherein said helmet-mounted system and a helmet-mounted portion of said cordless communications link are implemented using low-power electrical components powered exclusively by at least one helmet-mounted battery.

* * * * *

UNITED STATES PATENT AND TRADEMARK OFFICE

CERTIFICATE OF CORRECTION

PATENT NO. : 6,667,694 B2
DATED : December 23, 2003
INVENTOR(S) : Ben-Ari, Ben-Horin It is certified that error appears in the above-identified patent and that said Letters Patent is hereby corrected as shown below:

Title page,
Item [73], Assignee's name should be spelled -- Rafael-Armament Development Authority Ltd. --

Column 11,
Line 60, after the fourth word appears "50°" instead of -- 5° --.

Signed and Sealed this

Thirtieth Day of March, 2004

JON W. DUDAS
*Acting Director of the United States Patent and Trademark Office*